US006546902B1

(12) United States Patent
Davis

(10) Patent No.: US 6,546,902 B1
(45) Date of Patent: Apr. 15, 2003

(54) INTAKE AND EXHAUST VALVE SYSTEM

(75) Inventor: Kim Davis, Duncraig (AU)

(73) Assignee: Ax-Tec Pty. Ltd., Duncraig (AU)

( * ) Notice: Subject to any disclaimer, the term of this patent is extended or adjusted under 35 U.S.C. 154(b) by 0 days.

(21) Appl. No.: 09/621,631

(22) Filed: Jul. 21, 2000

Related U.S. Application Data

(63) Continuation-in-part of application No. PCT/AU99/00049, filed on Jan. 22, 1999.

(30) Foreign Application Priority Data

Jan. 23, 1998 (AU) ..... PP 1523

(51) Int. Cl.[7] ..... F01L 1/28
(52) U.S. Cl. ..... 123/79 C
(58) Field of Search ..... 123/79 C, 90.1, 123/188.4, 188.1, 188.5, 190.4

(56) References Cited

U.S. PATENT DOCUMENTS

| | | | | | |
|---|---|---|---|---|---|
| 2,439,618 | A | * | 4/1948 | Cloutier | 123/79 C |
| 4,094,277 | A | * | 6/1978 | Goto et al. | 123/79 C |
| 4,449,490 | A | | 5/1984 | Hansen | 123/79 C |
| 4,893,592 | A | | 1/1990 | Falero | 123/79 C |
| 4,957,073 | A | | 9/1990 | Bergeron | 123/79 C |
| 5,355,848 | A | | 10/1994 | Denton | 123/79 C |
| 5,782,215 | A | * | 7/1998 | Engelmann | 123/79 C |
| 6,237,549 | B1 | * | 5/2001 | Huff | 123/79 C |

* cited by examiner

*Primary Examiner*—Bibhu Mohanty
(74) *Attorney, Agent, or Firm*—Dougherty, Clements & Hofer

(57) ABSTRACT

An intake and exhaust valve system (10) for an internal combustion engine having a combustion chamber (19) within a cylinder (13) closed at one end by a cylinder head (17). A cavity (25) is provided in the cylinder head opening onto the combustion chamber through a first port (27). The valve system (10) has first and second valves one of which is an intake valve (31) movable between open and closed conditions for controlling intake fluid flow into the combustion chamber (19) and the other of which is an exhaust valve (33) movable between open and closed conditions for controlling exhaust gas flow from the combustion chamber. The first valve (31) comprises a valve head (35) sealingly engagable with the first port (27) and a skirt structure (31). The skirt structure (37) is in sliding and sealing engagement with a tubular wall structure (49) within the cavity (25) whereby the skirt structure and wall structures cooperate to divide the cavity (25) into an inner cavity section (51) and an outer cavity section (53) surrounding the inner cavity section. A first flow passage (26) communicates with the outer cavity section (53) and a second flow passage (28) communicating with the inner cavity section (51). The second valve (33) is disposed in the first valve (31) for opening and closing a second port (61) in the first valve (31) for controlling fluid flow between the combustion chamber (19) and inner cavity section (51) wherein the skirt structure (37) has a first axial length and the tubular wall structure (49) has a second axial length with the first axial length being less than the second axial length. This arrangement provides a concentric intake and exhaust valve system with reduced reciprocating mass.

20 Claims, 16 Drawing Sheets

INTAKE AND EXHAUST VALVE SYSTEM

CROSS REFERENCE TO RELATED APPLICATION

This application is a continuation-in-part and claims the benefit of PCT Application No. PCT/AU99/00049 filed on Jan. 22, 1999.

TECHNICAL FIELD

The present invention relates to an intake and exhaust valve system for an internal combustion engine.

BACKGROUND OF THE INVENTION

Intake and exhaust valve systems commonly used in relation to internal combustion engines include rotary, sleeve and poppet valves. Of such valves, poppet valves are favoured and are predominantly in use. In typical arrangements, intake and exhaust poppet valves are separate from each other.

There is an inherent limitation in the size of separate intake and exhaust poppet valves that can be used, as such valves must open onto the top of the combustion chamber with which they are associated. There is a benefit in maximising the size of the valve openings onto the combustion chamber as this enhances the charge volume per unit time available for intake and exhaust processes, which leads to improved performance of the engine in terms of its efficiency and/or power output and which also provides improvements in the combustion process which can lead to a reduction in pollution. However, owing to their geometry, poppet valves cannot make effective use of the available area of the cylinder head. The valve openings thus provide constrictions to the flow of intake and exhaust fluids.

A further disadvantage with separate intake and exhaust poppet valves is the inherent asymmetric relationship of the poppet valves to the cylinder axis. As a result of the asymmetry, the fuel-air mixture is not introduced into the central region of the combustion chamber and so is not distributed evenly therein. Additionally, the exhaust gases do not discharge from the central area of the chamber. This asymmetry therefore limits the efficiencies at which the engine can perform the intake and exhaust processes.

With a view to alleviating the abovementioned disadvantages of separate intake and exhaust poppet valves of an internal combust ion engine, there have been various proposals to provide concentric intake and exhaust valve assemblies. Such proposals include the intake and exhaust valve systems disclosed in U.S. Pat. Nos. 4,957,073 (BERGERON), 4,449,490 (HANSEN), 5,355,848 (DENTON), and 4,893,592 (FALERO).

As identified in BERGERON, deficiencies of some of the prior proposals for concentric intake and exhaust valve systems include excessive mass associated with such arrangements, and loading problems caused by the relatively large surface area of the exhaust valve opening against compressed gases within the combustion chamber. BERGERON seeks to provide a concentric intake and exhaust valve system which provides an increased volume of charge per unit time through the engine per intake stroke and which also reduces the mass of the concentric valve assembly. Nevertheless, the intake and exhaust system proposed by BERGERON still presents a significant reciprocating mass which is undesirable.

FALERO utilises a concentric intake and exhaust valve system in which the outer intake valve has a hollow bell-shaped valve disc. The outer intake valve has a valve stem connected to the bell-shaped valve disc by radial arms, with the radial arms and the adjacent end of the valve stem being located within the confines of the bell-shaped valve disc. The bell-shaped valve disc has a generally cylindrical side wall with a flanged portion at the free end of the side wall to sealing contact with a valve seat and an inwardly curved section at the other end of the side wall. The cylindrical side wall slidingly engages an inner generally cylindrical surface defined by a somewhat annular projection positioned between the intake and exhaust ports. The annular projection co-operates with the cylindrical side wall of the bell-shaped valve disc to maintain separation between the intake and exhaust ports during movement of the outer intake valve.

FALERO does not address the problem of reciprocating mass, as is apparent from the size of the bell-shaped valve disc. Indeed, the intake and exhaust valve system proposed by FALERO utilises an arrangement in which the axial length of the side wall of the bell-shaped valve disc exceeds the axial length of the cylindrical surface on the annular projection.

There is no apparent need for the side wall of the bell-shaped valve disc to be of such length, unless the inwardly curved section at the end thereof opposed to the flanged portion is also required to seat against the annular projection when the valve is in the closed condition.

In any event, the size of the cylindrical side wall on the bell-shaped valve disc is disadvantageous in that it provides the valve with a significant reciprocating mass which is undesirable.

A further disadvantage of FALERO is location of the radial arms connecting the bell-shaped valve disc. Because the adjacent end of the valve stem is located within the confines of the hollow bell-shaped valve disc through which there is fluid flow, the presence of the valve stem can have the effect of reducing the cross-sectional flow area within the valve, so providing a restriction to flow.

A still further disadvantage of FALERO is that the annular projection forming the cylindrical surface cannot be readily refurbished or replaced in the event of excessive wear or damage.

SUMMARY OF THE INVENTION

The present invention seeks to provide an intake and exhaust valve system which has a reduced reciprocating mass in comparison to the prior art referred to above or at least provides a useful choice as an alternative to such prior art proposals. The present invention provides an intake and exhaust valve system for an internal combustion engine having a combustion chamber within a cylinder closed at one end by a cylinder head, the valve system comprising a cavity in the cylinder head opening onto the combustion chamber through a first port; a valve assembly comprising first and second valves one of which is an intake valve movable between open and closed conditions for controlling intake fluid flow into the combustion chamber and the other of which is an exhaust valve movable between open and closed conditions for controlling exhaust gas flow from the combustion chamber; the first valve comprising a valve head sealingly engagable with the first port and a skirt structure; the skirt structure being in sliding and sealing engagement with a wall structure within the cavity whereby the skirt and wall structures cooperate to divide the cavity into an inner cavity section and an outer cavity section surrounding the inner cavity section; a first flow passage communicating with the outer cavity section; and a second flow passage communicating with the inner cavity section; the second valve being disposed in the first valve for opening and closing a second port in the first valve for controlling fluid flow between the combustion chamber and inner cavity section; wherein the skirt structure has a first axial length and the tubular wall structure has a second axial length, the first axial length being less than the second axial length.

This arrangement provides a concentric intake and exhaust valve system with reduced reciprocating mass in comparison to the prior art proposals referred to hereinbefore. The reduction in reciprocating mass is accomplished by an arrangement: (a) which utilises the skirt structure (which forms part of the reciprocating mass) and the wall structure (which does not form part of the reciprocating mass) to separate the intake and exhaust gas flow paths; and (b) in which the axial length of the skirt structure is less than the axial length of the wall structure. Indeed, it is desirable to endeavour to have the axial length of the skirt structure as small as possible so as to minimise reciprocating mass, while of course maintaining an effective length having regard to factors such as height of valve lift and sealing integrity between the wall structure and the skirt structure. The skirt structure is preferably cylindrical, as is also the face of the wall structure with which the skirt structure slidingly and sealingly engages.

The skirt structure may be sealingly engagable with the wall structure by way of any suitable means such as a close sliding fit or by sealing means such as sealing rings provided therebetween.

While the wall structure may be formed integrally with the cylinder head, it is more likely to be formed either separately thereof and attached thereto in any suitable fashion, or formed in two sections one of which is integral with the cylinder head the other of which is connected to said one section.

The first valve preferably has a valve stem connected to the skirt structure. The connection between the valve stem and the skirt structure may be provided by one or more connecting elements extending therebetween. Conveniently, the or each connecting element presents a thin profile in the direction of fluid flow so as to minimise any disturbance to such flow.

Preferably, the valve stem is located outside of the confines of the skirt structure.

The first valve stem may be hollow to provide an axial passage in which the stem of the second valve is received. The second valve stem is preferably guidingly supported within the hollow first valve stem for reciprocation relative thereto.

The second valve stem may extend beyond the first valve stem.

The first valve stem and the second valve stem are preferably connected to means operable to move the first and second valves between their respective open and closed conditions in timed sequence.

A first valve biasing means such as a valve spring may be provided for biasing the first valve into the closed condition.

A second valve biasing means such as a valve spring may be provided for biasing the second valve into the closed condition.

The present invention further provides an intake and exhaust valve system for an internal combustion engine having a combustion chamber within a cylinder closed at one end by a cylinder head, the valve system comprising a cavity in the cylinder head opening onto the combustion chamber through an intake port; a valve assembly comprising an intake valve movable between open and closed conditions for controlling intake fluid flow into the combustion chamber and an exhaust valve movable between open and closed conditions for controlling exhaust gas flow from the combustion chamber; the intake valve comprising a valve head sealingly engagable with the intake port and a skirt structure; the skirt structure being in sliding and sealing engagement with a wall structure whereby the skirt and wall structures cooperate to divide the cavity into an inner cavity section and an outer cavity section surrounding the inner cavity section; an of intake flow passage communicating with the outer cavity section for delivery intake fluid thereto; and an exhaust flow passage communicating with the inner cavity section; the exhaust valve being disposed in the intake valve for opening and closing an exhaust port in the intake valve for controlling exhaust gas from the combustion chamber into the inner cavity section; wherein the skirt structure has a first axial length and the wall structure has a second axial length, the first axial length being less than the second axial length.

The present invention still further provides an intake and exhaust valve system for an internal combustion engine having a combustion chamber within a cylinder closed at one end by a cylinder head, the valve system comprising a cavity in the cylinder head opening onto the combustion chamber through an exhaust port; a valve assembly comprising an intake valve movable between open and closed conditions for controlling intake fluid flow into the combustion chamber and an exhaust valve movable between open and closed conditions for controlling exhaust gas flow from the combustion chamber; the exhaust valve comprising a valve head sealingly engagable with the exhaust port and a skirt structure; the skirt structure being in sliding and sealing engagement with a wall structure whereby the skirt and wall structures cooperate to divide the cavity into an inner cavity section and an outer cavity section surrounding the inner cavity section; an intake flow passage communicating with the inner cavity section for delivery of intake fluid thereto; and an exhaust flow passage communicating with the outer cavity section; the intake valve being disposed in the exhaust valve for opening and closing an intake port in the exhaust valve for controlling delivery of intake fluid into the combustion chamber; wherein the skirt structure has a first axial length and the wall structure has a second axial length, the first axial length being less than the second axial length.

The present invention still further provides an intake and exhaust valve system for an internal combustion engine having a combustion chamber within a cylinder closed at one end by a cylinder head, the valve system comprising a cavity in the cylinder head opening onto the combustion chamber through a first port; a valve assembly comprising first and second valves one of which is an intake valve movable between open and closed conditions for controlling intake fluid flow into the combustion chamber and the other of which is an exhaust valve movable between open and closed conditions for controlling exhaust gas flow from the combustion chamber; the first valve comprising a valve head sealingly engagable with the first port and a skirt structure; a wall structure provided in the cavity, with the wall structure or at least a section thereof being removably mounted in the cavity; the skirt structure being in sliding and sealing engagement with the wall structure within the cavity whereby the skirt and wall structures cooperate to divide the cavity into an inner cavity section and an outer cavity section surrounding the inner cavity section; a first flow passage communicating with the outer cavity section; and a second flow passage communicating with the inner cavity section; the second valve being disposed in the first valve for opening and closing a second port in the first valve for controlling fluid flow between the combustion chamber and inner cavity section.

The present invention provides an intake and exhaust valve system for an internal combustion engine having a combustion chamber within a cylinder closed at one end by a cylinder head, the valve system comprising a cavity in the cylinder head opening onto the combustion chamber through a first port; a valve assembly comprising first and second valves one of which is an intake valve movable between open and closed conditions for controlling intake fluid flow into the combustion chamber and the other of which is an exhaust valve movable between open and closed conditions for controlling exhaust gas flow from the combustion chamber; the first valve comprising a valve head sealingly engagable with the first port and a skirt structure; the skirt structure being in sliding and sealing engagement with a wall structure within the cavity whereby the skirt and wall structures cooperate to divide the cavity into an inner cavity section and an outer cavity section surrounding the inner cavity section; a first flow passage communicating with the outer cavity section; and a second flow passage communicating with the inner cavity section; the second valve being disposed in the first valve for opening and closing a second port in the first valve for controlling fluid flow between the combustion chamber and inner cavity section; the first valve having a valve stem connected to the skirt structure by at least one connecting element, said valve stem being disposed entirely outside of the confines of the skirt structure.

The present invention still further provides a cylinder head for accommodating an intake and exhaust system as previously defined, the cylinder head comprising a body having a cavity and an insert removably received in the body, the first and second valves being mounted in the insert.

BRIEF DESCRIPTION OF THE DRAWINGS

The invention will be better understood by reference to the following description of several specific embodiments thereof as shown in the accompanying drawings in which.

DESCRIPTION OF PREFERRED EMBODIMENTS

Figure 2:
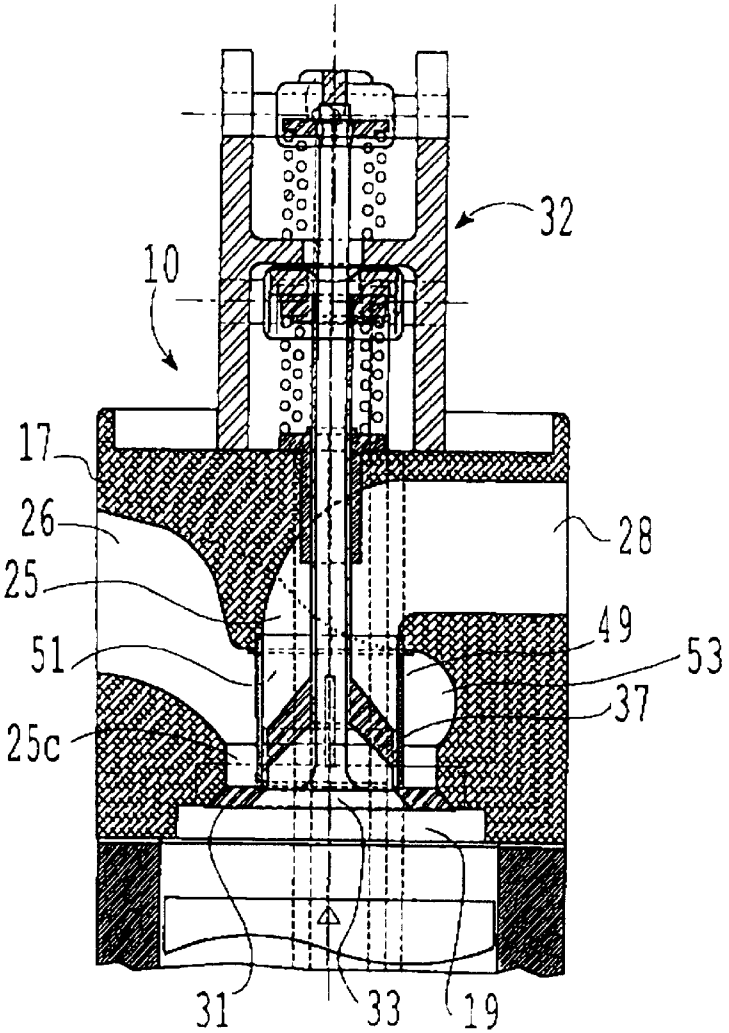
FIG. 2 is a side view of FIG. 1.

The first embodiment shown in FIGS. 1 to 10 of the drawings is directed to an intake and exhaust valve system 10 for a four-stroke internal combustion engine comprising a cylinder block 11 defining a cylinder 13. A piston 15 is mounted for reciprocation within the cylinder 13 and is connected to a crankshaft (not shown) in conventional fashion. A cylinder head 17 is mounted on the cylinder block 11 and closes one end of the cylinder 13. A combustion chamber 19 is defined within the cylinder 13 between the piston 15 and the cylinder head 17. The cylinder head 17 incorporates a threaded hole 21 for installation of a spark plug (not shown) for ignition of a combustible mixture in the combustion chamber 19.

The intake and exhaust valve system 10 is provided for controlling the introduction of a combustible air/fuel mixture into the combustion chamber 19 and for controlling the discharge of spent products of combustion (exhaust gases) from the combustion chamber.

The valve system 10, comprises a cavity 25 formed in the cylinder head 17. The cavity 25 comprises a generally cylindrical upper section 25*a*, a somewhat bulbous intermediate section 25*b*, and a generally cylindrical lower section 25*c*. The cavity 25 opens onto the combustion chamber 19 at the lower section 25*c* by way of an intake port 27 which is surrounded by a valve seat 29. At the junction between the upper section 25*a* and the intermediate section 25*b* there is an edge 22 which incorporates a circumferential recess 24, the purpose of which will become apparent later.

An intake fluid flow passage 26 is formed in the cylinder head 17 to communicate with the cavity 25 for delivery of an intake fluid thereto (the intake fluid in this embodiment being an air/fuel mixture but it may be air only in an engine having a direct-fuel injection system). An exhaust fluid flow passage 28 is also formed in the cylinder head to communicate with the cavity 25 for discharge of exhaust gases therefrom.

A valve assembly 30 comprises an intake valve 31 moveable between open and closed conditions in relation to the intake port 27 for controlling intake of the air-fuel mixture into the combustion chamber 19. The valve assembly 30 further comprises an exhaust valve 33 moveable between open and closed conditions for controlling flow of products of combustion from the combustion chamber 19.

Valve timing gear 32 of known kind is used to control movement of each valve 31, 33 between the open and closed conditions. The intake valve 31 and the exhaust valve 33 are each biased into the closed condition by a respective valve spring 34. The valve timing gear 32 includes push-rods 36 and rocker arms 38.

Figure 6:
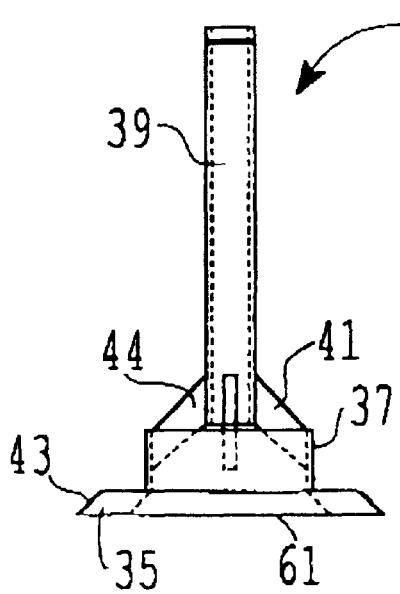
FIG. 6 is a side view of an intake valve used in the valve assembly.
Figure 7:
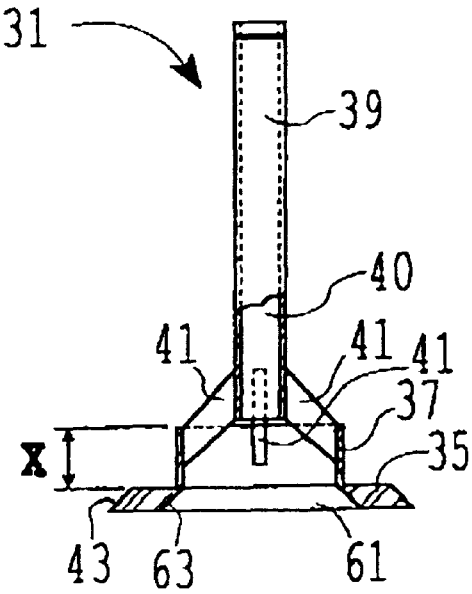
FIG. 7 is a sectional side view of the intake valve.
Figure 8:
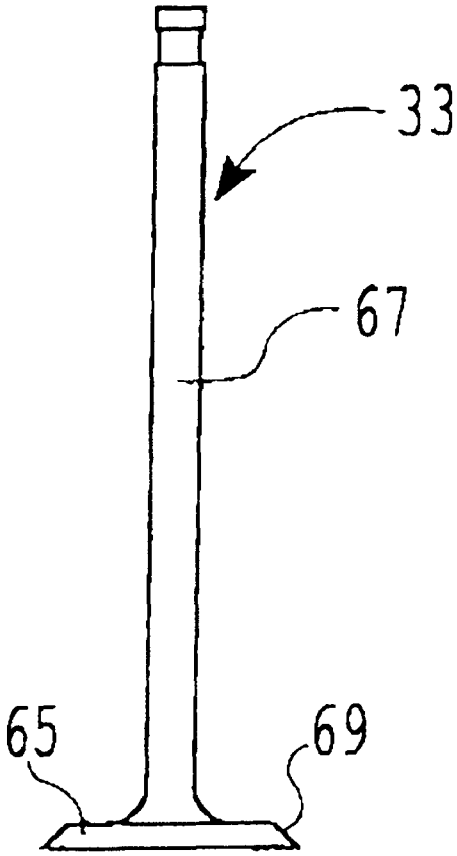
FIG. 8 is a side view of an exhaust valve used in the valve assembly.
Figure 9:
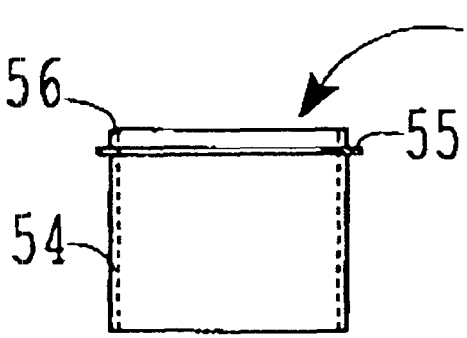
FIG. 9 is a side view of a wall structure forming part of the valve assembly.

The intake valve 31 comprises a valve head 35, a skirt structure 37, a hollow valve stem 39, and a connection structure 41 connecting the valve stem 39 to the skirt structure 37. The valve head 35 presents a valve face 43 which is adapted to sealingly engage the valve seat 29 of the intake port 27 when the intake valve is in a closed condition. The skirt structure 37 is of cylindrical construction and its purpose will be described later. The connection structure 41 extends between the skirt structure 37 and the valve stem 39 and comprises a plurality of connecting elements 44 in circumferentially spaced relationship to the valve stem, as best seen in FIG. 6 of the drawings. The connecting elements 44 each present a thin profile along the axial length of the valve stem so as to minimise any disturbance of fluid flow through the region defined between the skirt structure 37 and the valve stem 39, as will be explained in more detail later. The connecting elements 44 may extend substantially for the full axial length of the skirt structure 37 so as to provide adequate support between the skirt structure and the valve stem. The valve stem 39 is located entirely outside of the confines of the skirt structure 37 so as not to require the cross-sectional flow area within the skirt structure.

The skirt structure 37 is in sliding and sealing engagement with a wall structure 49 disposed within the cavity 25 whereby the skirt and the tubular wall structure cooperate to divide the cavity into an inner cavity section 51 and an outer cavity section 53 which surrounds the inner cavity section.

Figure 1:
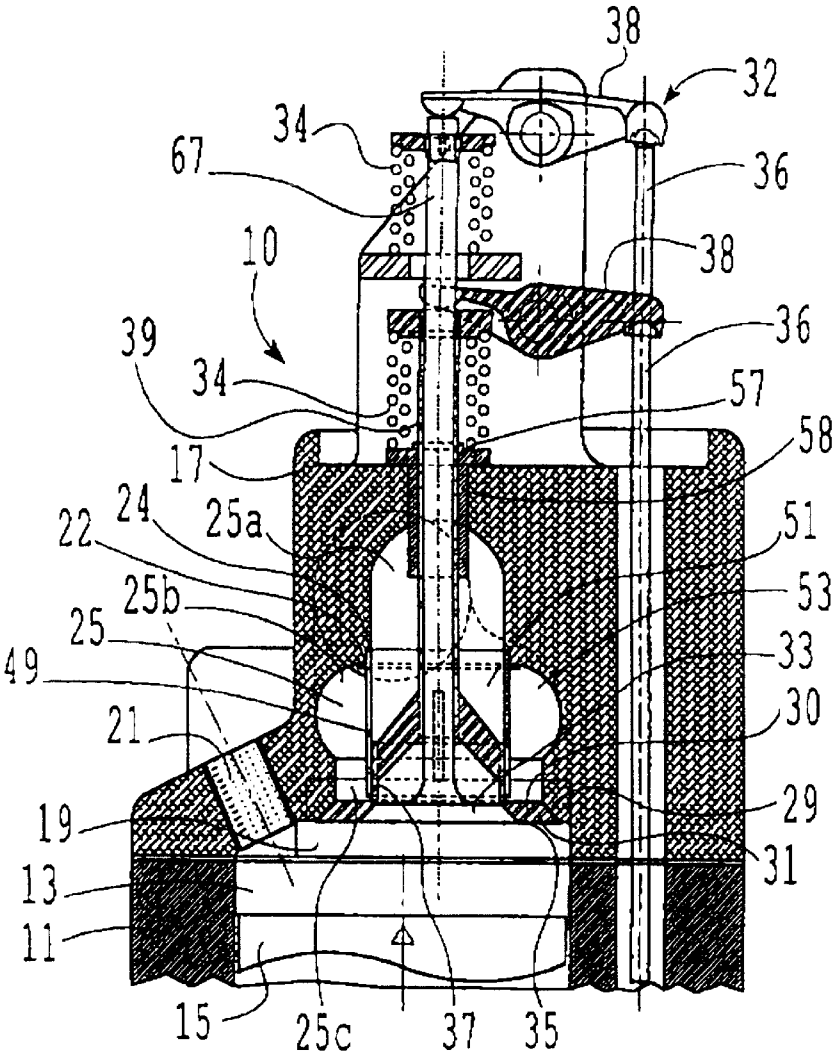
FIG. 1 is a schematic sectional view of a cylinder head incorporating an intake and exhaust valve system according to a first embodiment, with the intake and exhaust valves being shown in the closed condition.
Figure 4:
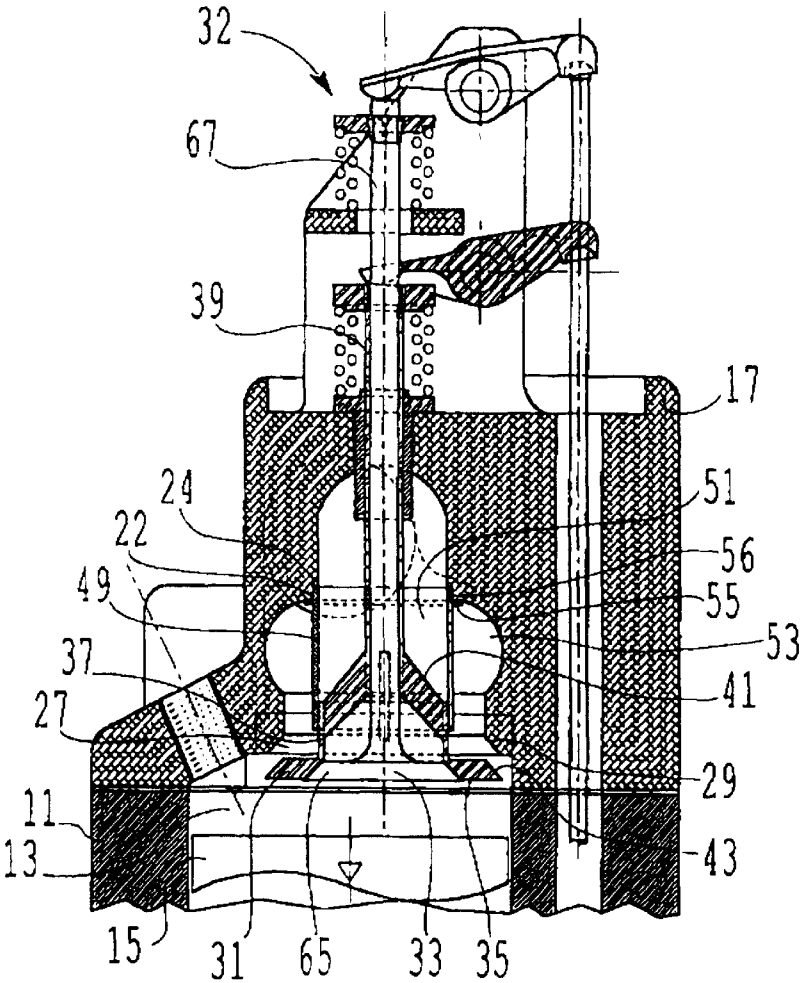
FIG. 4 is also a view similar to FIG. 1 with the exception that the intake valve is also shown in an open condition.
Figure 3:
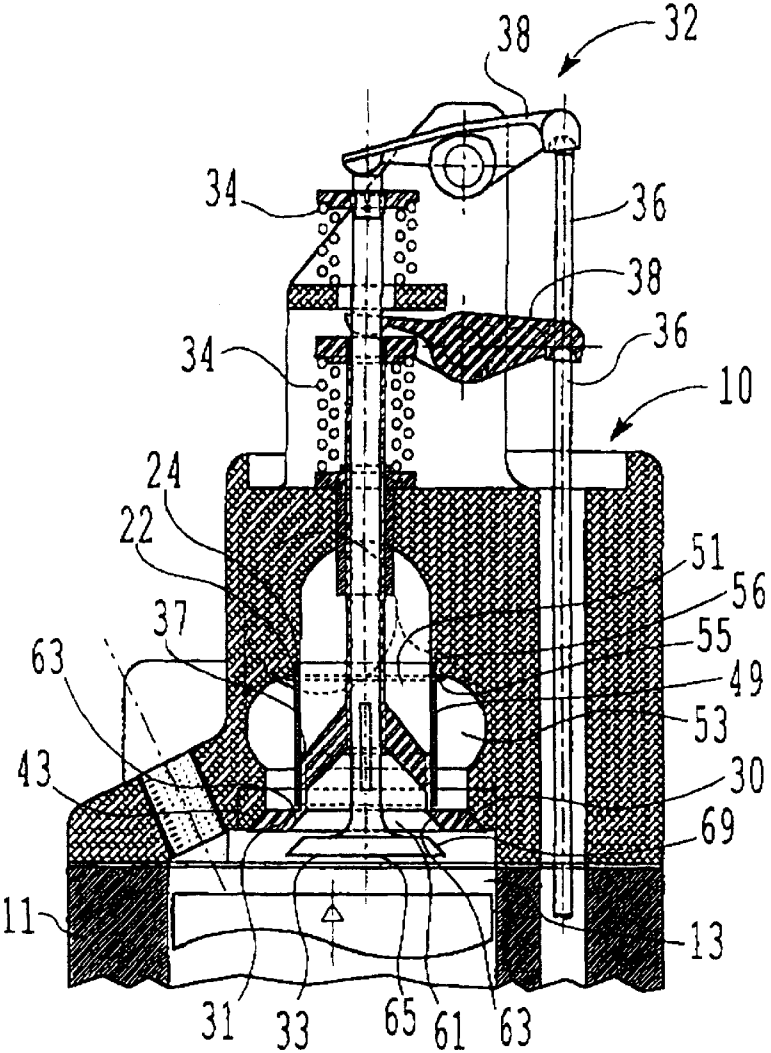
FIG. 3 is view similar to FIG. 1 with the exception that the exhaust valve is shown in an open condition.
Figure 5:
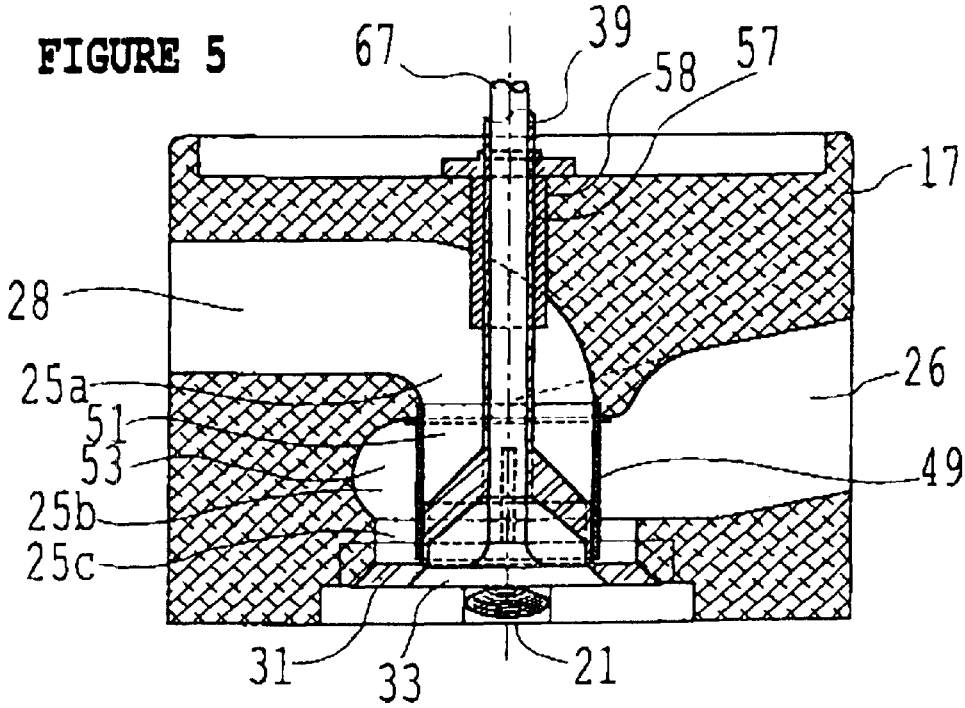
FIG. 5 is a side view of the cylinder head showing intake and exhaust passages forming part of the intake and exhaust valve system.

The wall structure 49 is defined by an annular body 54 adapted to be releasably mounted in the cavity 25. The wall structure 49 is of generally tubular construction, comprising an annular body 54 having a mounting flange portion 55 adjacent to, and inwardly spaced from, one end of the annular body. The inward spacing of the mounting flange portion 55 provides the annular body 54 with a locating portion 56 on the body at said one end thereof. The locating portion 56 of the annular body is adapted to be received in the circumferential recess 24 in the edge 22 between the upper and intermediate cavity sections 25*a* and 25*b* respectively, with the mounting flange portion 55 bearing against the edge 22, as best seen in FIGS. 1, 3 and 4. The mounting flange portion 55 is adapted to be detachably secured to the cylinder head 17 in any suitable fashion such as by machine screws (not shown). The portion of the annular body 54 other than the locating portion 56 defines the tubular wall structure 49.

Because the wall structure 49 is removably mounted in the cavity, it can be removed for refurbishment or replacement as necessary.

The skirt structure 37 is sealingly engagable with the wall structure 49 by way of a close sliding fit which provides an effective seal therebetween while allowing reciprocation of the skirt structure with respect to the wall structure.

Figure 10:
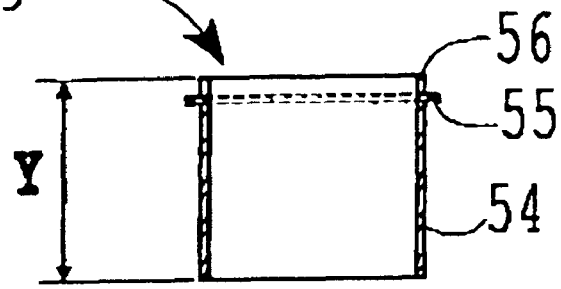
FIG. 10 is a sectional side view of the wall structure.

The skirt structure 37 has an axial length (as identified by reference character X is FIG. 7) which is less than the axial length of the wall structure 49 (as identified by reference character Y in FIG. 10). Such an arrangement is intended to reduce the reciprocating mass of the intake valve 31. Indeed, it is desirable for the axial length X of the skirt structure to be as small as practicable so as to minimise reciprocating mass while of course maintaining sufficient length in order to provide effective operation in combination with the wall structure, having regard to factors such as height of valve lift and integrity of sealing between the wall structure and the skirt structure.

The stem 39 of the intake valve 31 extends axially through the cavity 25 and through a guide hole 57 axially aligned therewith in the cylinder head 17. The guide hole 57 is defined by a guide sleeve 58 mounted in the cylinder head 17.

The hollow stem 39 has an axial passage 40 which includes two portions (not shown) of reduced section which provide bearing surfaces.

The valve head 35 incorporates an exhaust port 61 which provides fluid communication between the inner cavity section 51 and the combustion chamber 19. The exhaust port 61 is surrounded by a valve seat 63.

The exhaust valve 33 is disposed within the intake valve 31 for opening and closing the exhaust port 61 defined within the intake valve 31 for controlling flow of the exhaust gases from the combustion chamber 19.

The exhaust valve 33 comprises a valve head 65 and a valve stem 67. The valve head 65 presents a valve face 69 which is adapted to sealingly engage the exhaust port valve seat 63 in the exhaust port 61 when the exhaust valve is in a closed condition.

The exhaust valve stem 67 is slidably supported within the axial passage 40 of the hollow valve stem 37 of the intake valve 31 for guided movement therealong. The bearing surfaces (not shown) in the axial passage 40 within the hollow valve stem 39 slidingly and guidingly support the valve stem 67 while limiting the extent of contact between the two stems thereby to reduce frictional losses.

The valve stem 67 of the exhaust valve 33 extends beyond the valve stem 39 of the intake valve 31, as shown in the drawings.

The intake valve stem 39 and the exhaust valve stem 67 are responsive to the valve timing gear 32 operable to move the intake and exhaust valves between their respective open and closed conditions in timed sequence.

Operation of the intake and exhaust valve system according to the embodiment will now be described.

FIG. 1 of the drawings shows both the intake and exhaust valves 31, 33 in their respective closed conditions. The valve system will be described in operation from commencement of the exhaust stroke where the inlet and exhaust valves 31, 32 are initially in their closed conditions. During the exhaust stroke, the exhaust valve 33 is caused to move from the closed condition to the open conditions out of engagement with the exhaust port 61 within the inlet valve 31, as shown in FIG. 3. Exhaust gases under pressure within the combustion chamber 19 can then flow through the exhaust port 61 into the inner cavity section 51 and then into the exhaust flow passage 28. The exhaust valve subsequently closes to complete the exhaust stage. In this embodiment there is overlap in the timing of operation of the intake and exhaust valves 31, 33 such that the inlet valve 31 commences to open while the exhaust valve 33 is open. With this arrangement, the inlet valve 31 moves away from its valve seat and out to meet the exhaust valve 33 while the later is open so as to effect closing of the exhaust valve, as shown in FIG. 4. Opening of the inlet valve 31 allows a combustible air-fuel mixture to flow along the intake passage 26 into the outer cavity section 53 and enter the combustion chamber 19 through the inlet port 27. At the completion of the intake stroke, the intake valve 31 returns to the closed conditions as shown in FIG. 1 of the drawings, together with the closed exhaust valve 33. During reciprocation of the inlet valve 31 between the open and closed conditions, the skirt 37 maintains sealing engagement with the tubular wall structure 49. This ensures that there are separate flow paths for the intake mixture and the exhaust gases.

In this embodiment, the intake valve 31 is the outer of the two valves in the concentric valve assembly 30. There are several advantages to such an arrangement, one being that the outer valve is larger and so provides less restriction to fluid flow, which is beneficial in terms of the intake process. Another advantage is that the intake mixture can be in heat exchange relationship with the cylinder head 17 (and more particularly with the tubular wall structure 49 and with the intake valve 31) and so receive heat therefrom and so provide some cooling.

From the foregoing, it is evident that the feature of the skirt on the outer of the two concentric valves operating in combination with the internal wall structure provides a simple yet highly effective arrangement for providing a reduction in the reciprocating mass of the concentric intake and exhaust valve system according to the embodiment.

In the first embodiment, the valve timing gear 34 for controlling operation of each of the intake and exhaust valves 31 and 33 respectively is of the underhead type.

Figure 11:
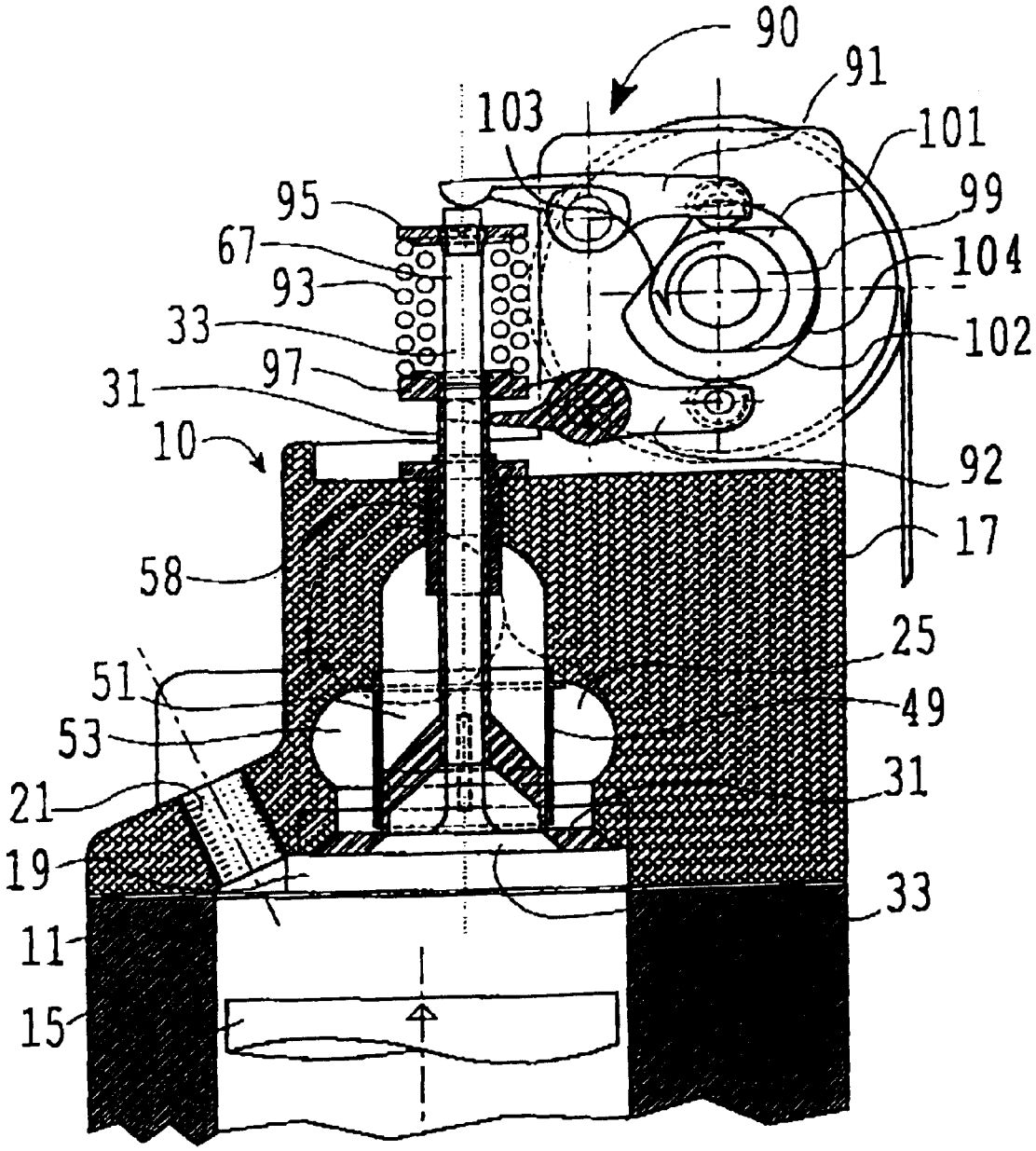
FIG. 11 is a schematic sectional view of a cylinder head incorporating valve system according to a second embodiment, with the intake and exhaust valves being shown in the closed condition.
Figure 12:
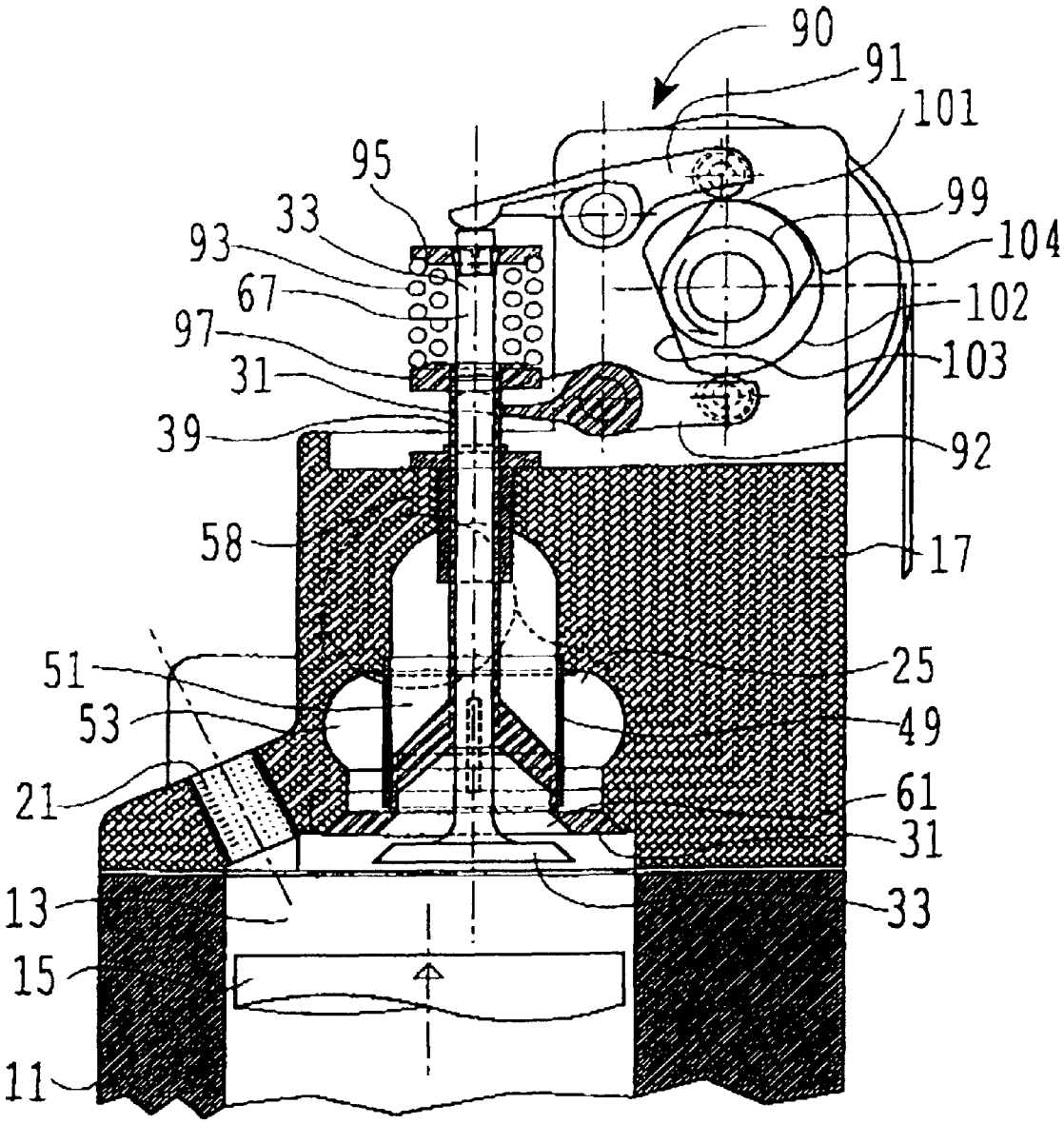
FIG. 12 is a view similar to FIG. 11 with the exception that the exhaust valve is shown in an open condition.
Figure 13:
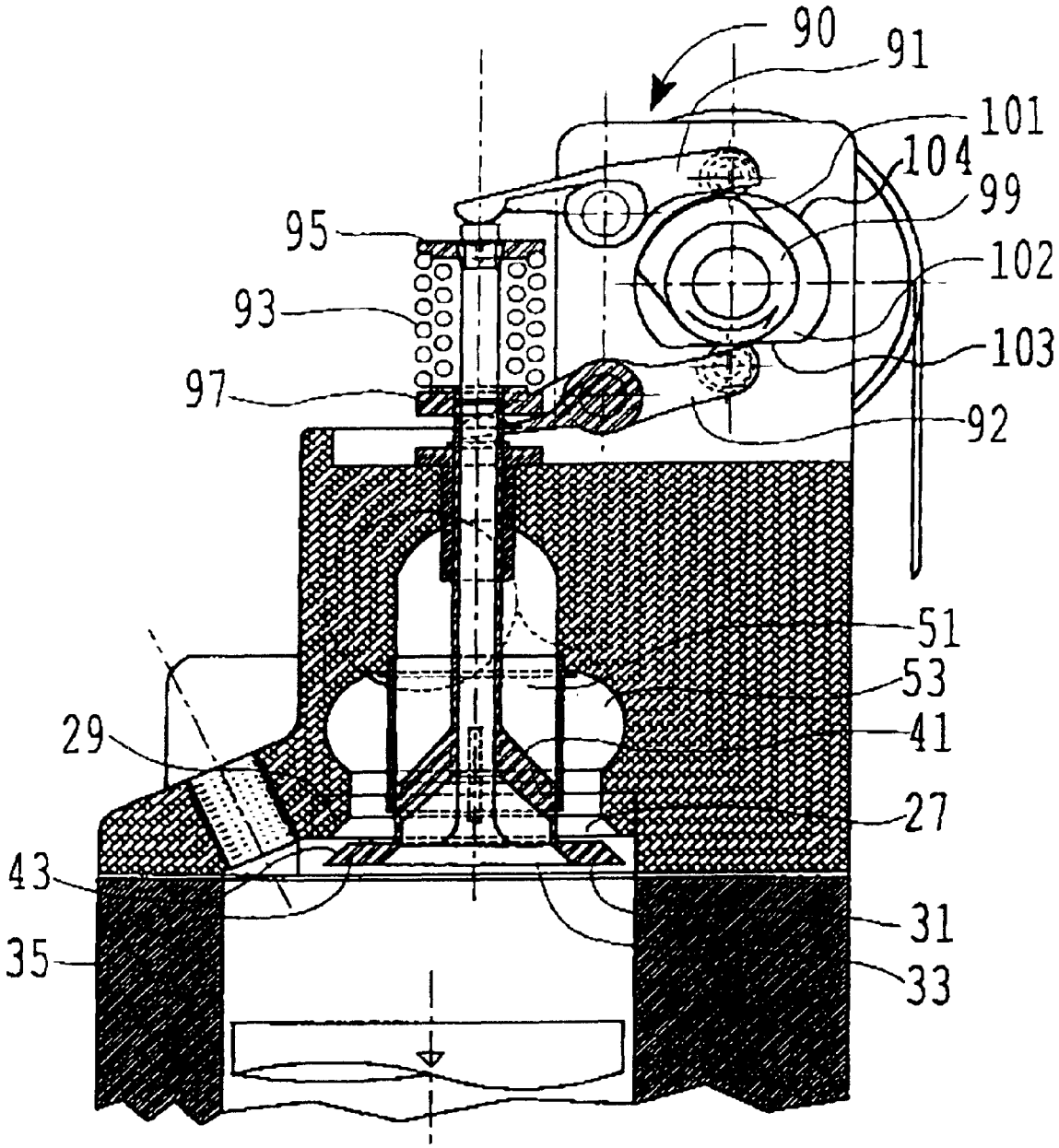
FIG. 13 is also a view similar to FIG. 11 with the exception that the intake valve is also shown in an open condition.
Figure 15:
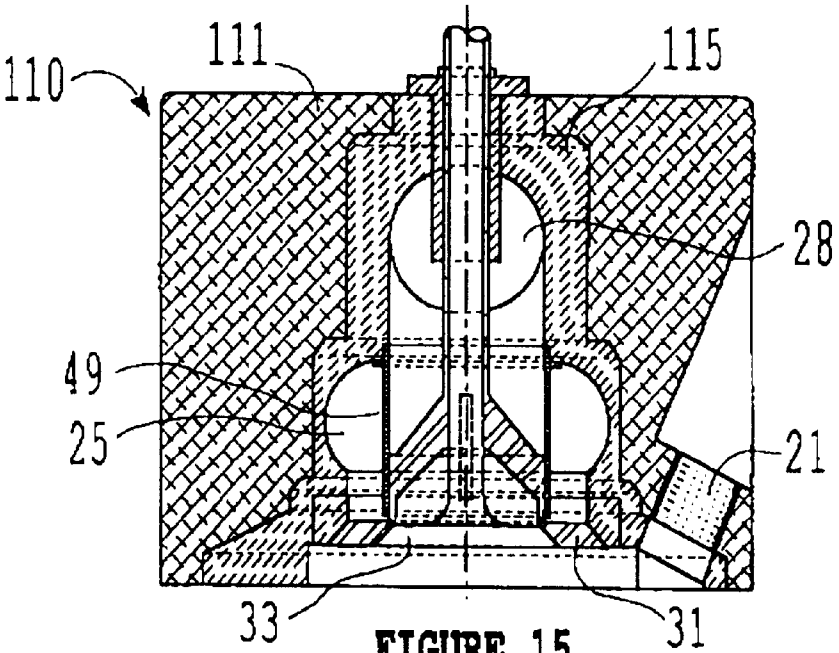
FIG. 15 is a side sectional view of the cylinder head of FIG. 14.
Figure 14:
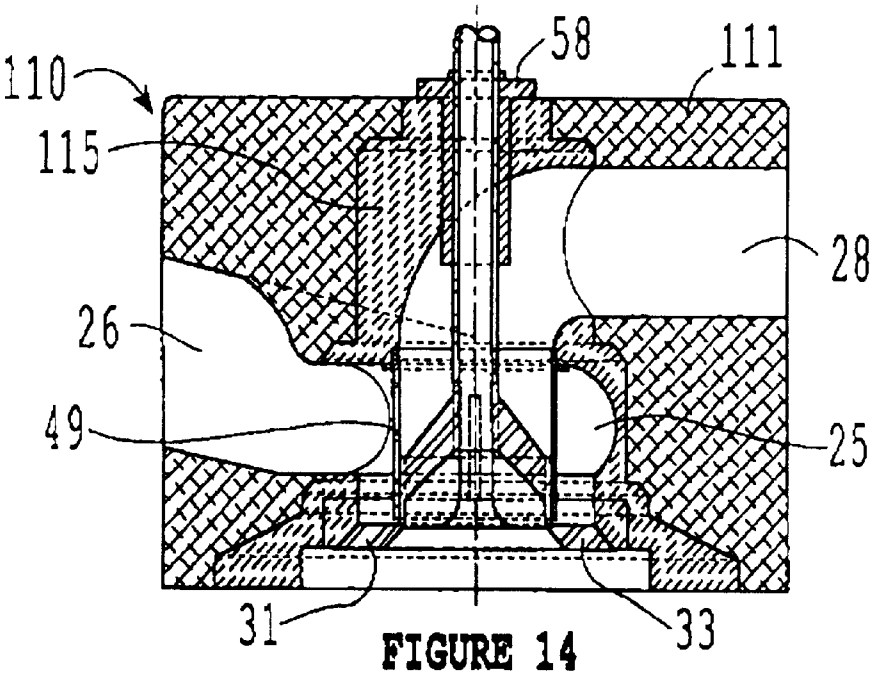
FIG. 14 is a schematic sectional view of a cylinder head of modular construction, incorporating an intake and exhaust valve system according to a third embodiment.
Figure 17:
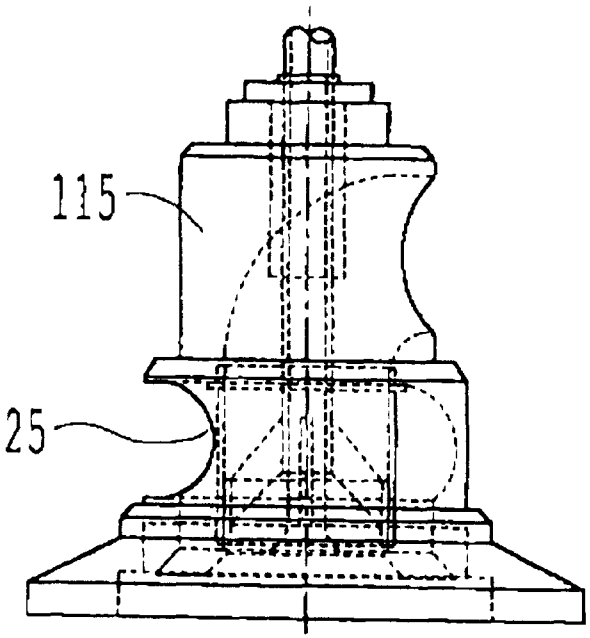
FIG. 17 is a side view of an insert adapted to be received in the body of FIG. 16.
Figure 16:
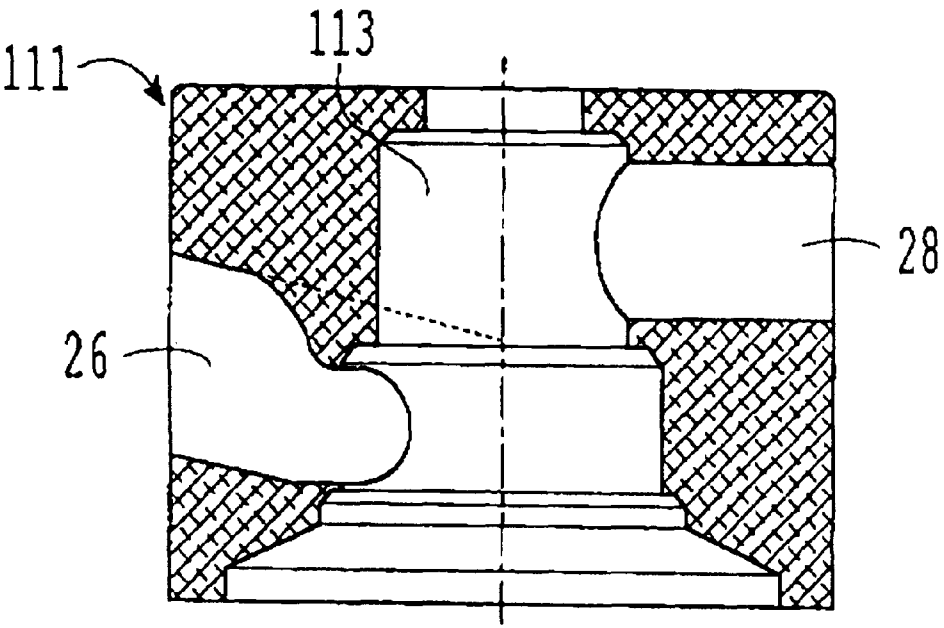
FIG. 16 is a sectional view of a body forming part of the cylinder head of FIG. 14.
Figure 18:
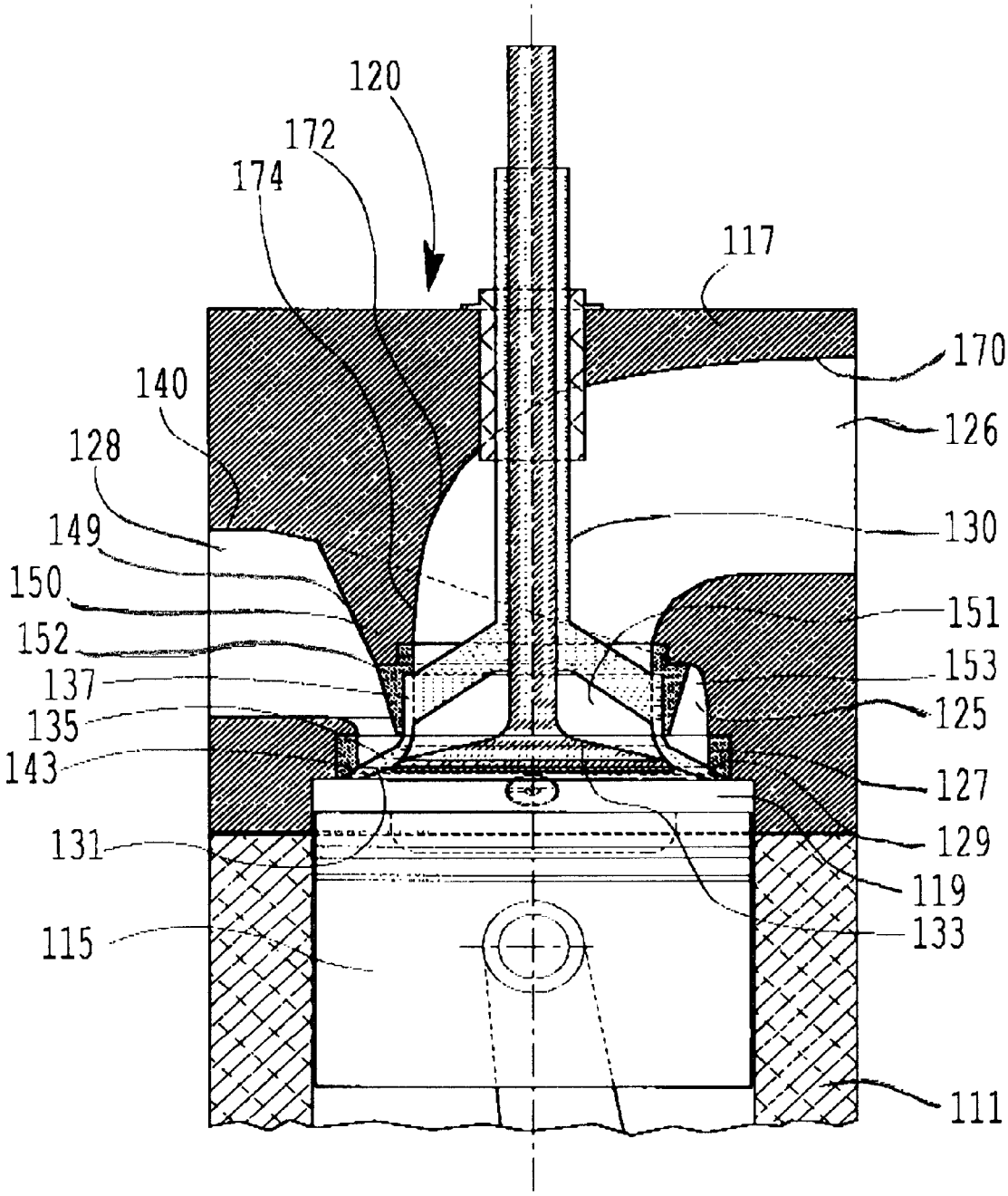
FIG. 18 is a schematic view of a cylinder head incorporating an intake and exhaust valve system according to a fourth embodiment, with the intake and exhaust valves being shown in the closed condition.
Figure 19:
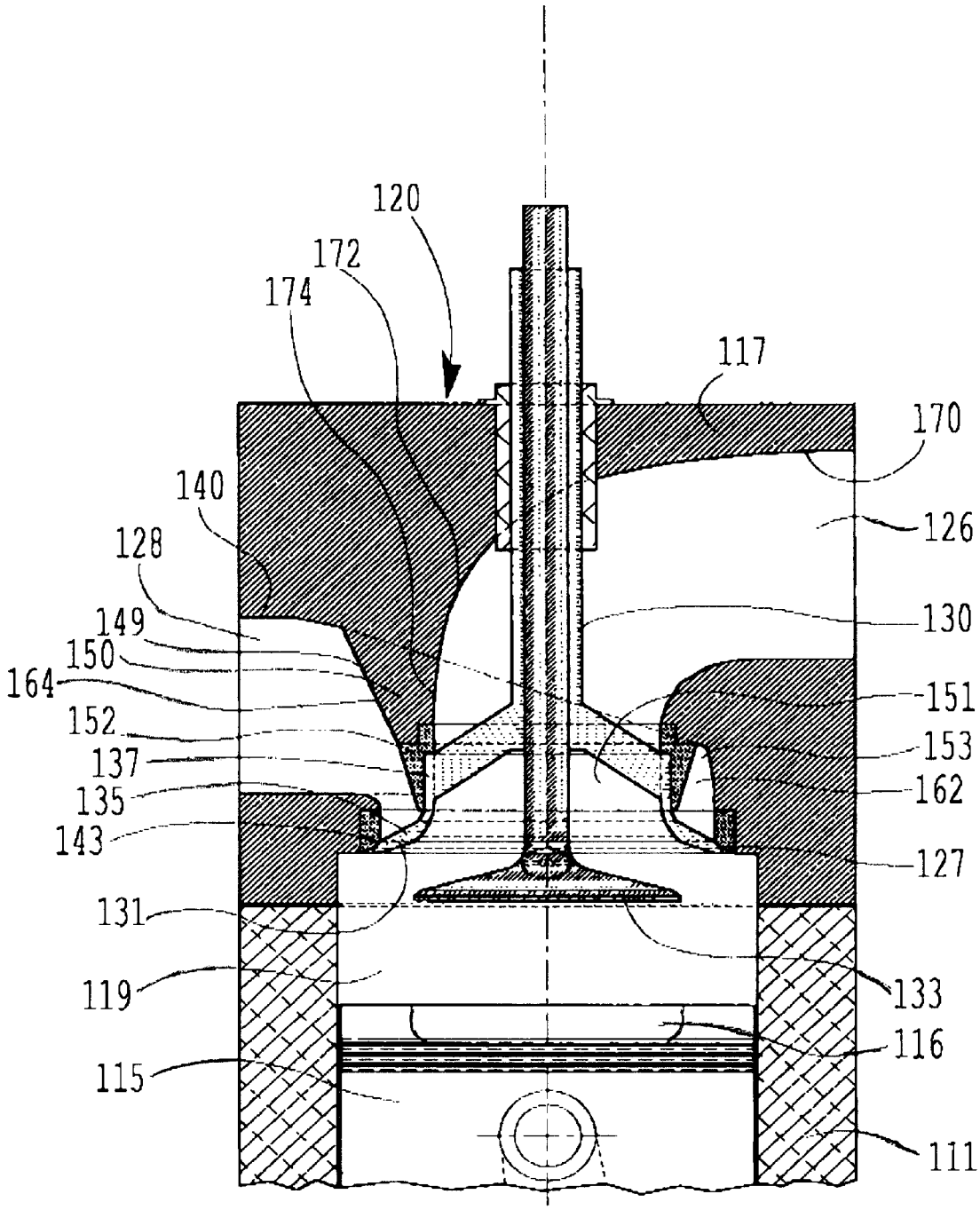
FIG. 19 is also a view similar to FIG. 18 with the exception that the intake valve is also shown in an open condition.
Figure 20:
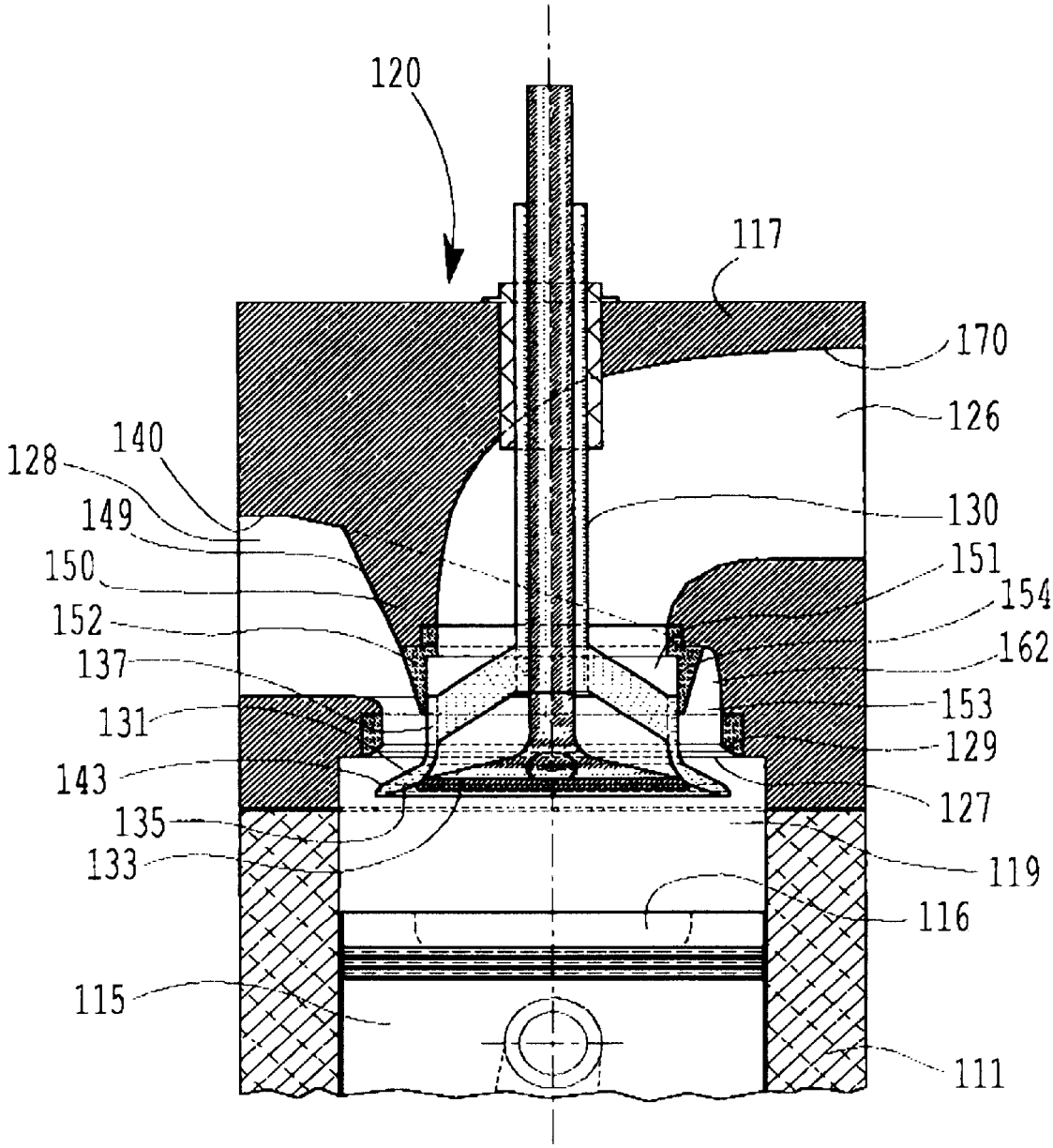
FIG. 20 is a view similar to FIG. 18 with the exception that the exhaust valve is shown in an open condition.
Figure 21:
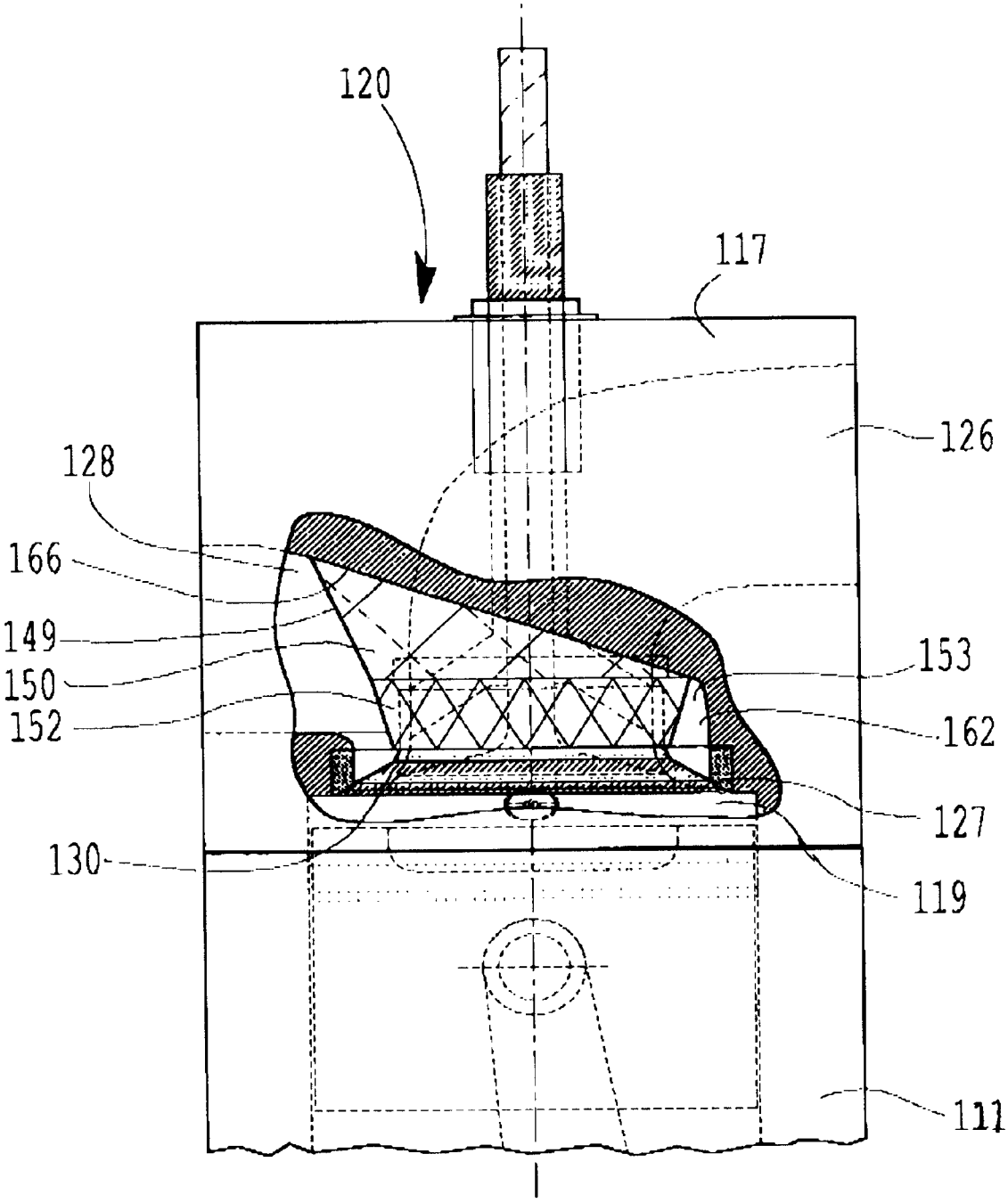
FIG. 21 is a side view of the cylinder head with part thereof cut away to show the exhaust passage forming part of the intake and exhaust valve system and a wall structure separating the exhaust passage from the intake passage.

Referring now to FIGS. 11, 12 and 13, the intake and exhaust valve system 10 according to the second embodiment is similar to that of the first embodiment except for the valve timing gear. In this embodiment, the valve timing gear 90 is of an overhead configuration which is not of conventional construction. The valve timing gear 90 employs an upper rocker arm 91 and a lower rocker arm 92. A valve spring 93 is accommodated between an upper spring retainer 95 which is attached to the stem 67 of the exhaust valve 33, and a lower spring retainer 97 which is attached to the stem 39 of the intake valve 31.

The upper and lower rocker arms 91 and 92 respectively are operated by a common cam 99 having two cam profiles 101, 102. The upper rocker arm 91 is operated by cam profile 101, and the lower rocker arm 92 is operated by cam profile 102.

The upper rocker arm 91 controls operation of the exhaust valve 33 and acts on the free end of the valve stem 67 thereof. The lower rocker arm 92 controls operation of the intake valve 31 and acts on the underside of the lower spring retainer 97 which is attached to the intake valve 31.

Referring to FIGS. 11 and 12, the lower rocker arm 92 is positioned on a lobe 104 of the cam 102, preventing the retainer 97 from moving towards the cylinder 13, keeping the intake valve 31 closed. When the lower rocker arm 92 is positioned on a flat 103 of the cam 102, the lower rocker arm 92 is 'relaxed', allowing the spring 93 to expand, as can be seen in FIG. 13, pushing the retaining 97 towards the cylinder 13, opening the intake valve 31.

This arrangement has the advantage of a common cam 99 and associated drive mechanism therefor, as well as a common valve spring 93.

In the first and second embodiments, the valve systems are incorporated into a cylinder head 17 which presents some difficulties in manufacture owing to the need to form the cavity 25 with its three sections 25*a*, 25*b* and 25*c*, and the associated intake passage 26 and exhaust passage 28, as well as the valve seat 29. Similarly, such a construction can present difficulties when repairs or refurbishment of the cylinder head is necessary.

With a view to reducing these difficulties, the intake and exhaust valve system according to the third embodiment, which is shown in FIGS. 14 to 17, utilises a cylinder head 110 of modular construction. The cylinder head 110 comprises a body 111 formed with a cavity 113 which receives an insert 115. The body 111 is formed with the intake passage 26 and exhaust passage 28 which open onto the cavity 113.

The insert 115 is formed with the cavity 25 and associated valve seat 29, and accommodates the intake valve 31 and exhaust valve 33.

When the insert 115 is received in the cavity 113 within the body 111, the cavity 25 in the insert registers with the intake passage 26 and exhaust passage 28 in the body 111. This then provides the cylinder head 110 incorporating a concentric intake arm exhaust valve system similar to the first and second embodiments.

This embodiment, however, has the advantage that the insert 115 (and accompanying intake valve 31 and exhaust valve 33) can simply be removed for repair or replacement, as necessary.

In the embodiments described previously, the wall structure 49 is formed entirely separately of the cylinder head 17 and is releasably mounted in position in the cavity 25 within the cylinder head. Other arrangements are possible. It may, for example, be possible to form the wall structure 49 either integrally, or at least partially integrally, with the cylinder head 17. One such arrangement is illustrated in the embodiment shown in FIGS. 18 to 24 of the drawings.

In the valve system 120 of the embodiment shown in FIGS. 18 to 24, the relative positions of the intake and exhaust ports are reversed in comparison to earlier embodiments. In particular, in the valve assembly 130 the outer (first) valve 131 functions as the exhaust valve and the inner (second) valve 133 functions as the inlet valve.

As with the earlier embodiments, the valve system 120 comprises a cavity 125 formed in the cylinder head 117. The cavity 125 opens onto the combustion chamber 119 by way of a port 127 which is surrounded by a valve seat 129. The port 127 functions as the exhaust port.

The exhaust valve 131 has a valve head 135 presenting a valve face 143 for engagement with the valve seat 129. The exhaust valve 131 also has a skirt structure 137 which co-operates with a surrounding wall structure 149 to divide the cavity 125 into an inner cavity section 151, and an outer cavity section 153 which surrounds the inner cavity section 151.

An intake fluid flow path 126 is formed in the cylinder head 117 for delivering an intake fluid to the inner cavity section 151.

An exhaust fluid flow passage 128 is formed in the cylinder head 117 for discharge of exhaust gases through the outer cavity section 153.

The surrounding wall structure 149 comprises a first portion 150 formed integrally with the cylinder head 117 and a second portion 152 formed separately of the cylinder head and attachably mounted thereon. The first portion 150 and the second portion 152 are configured to inter-engage and are detachably secured together in any suitable fashion such as by way of machine screws (not shown).

The second portion 152 presents an inner face 154 against which the skirt structure 137 can slidingly and sealingly engage.

The inlet fluid flow passage 126 has a boundary wall 170, the inner end section 172 of which defines the inner surface 174 of the first portion 150 of the wall structure 149.

Figure 24:
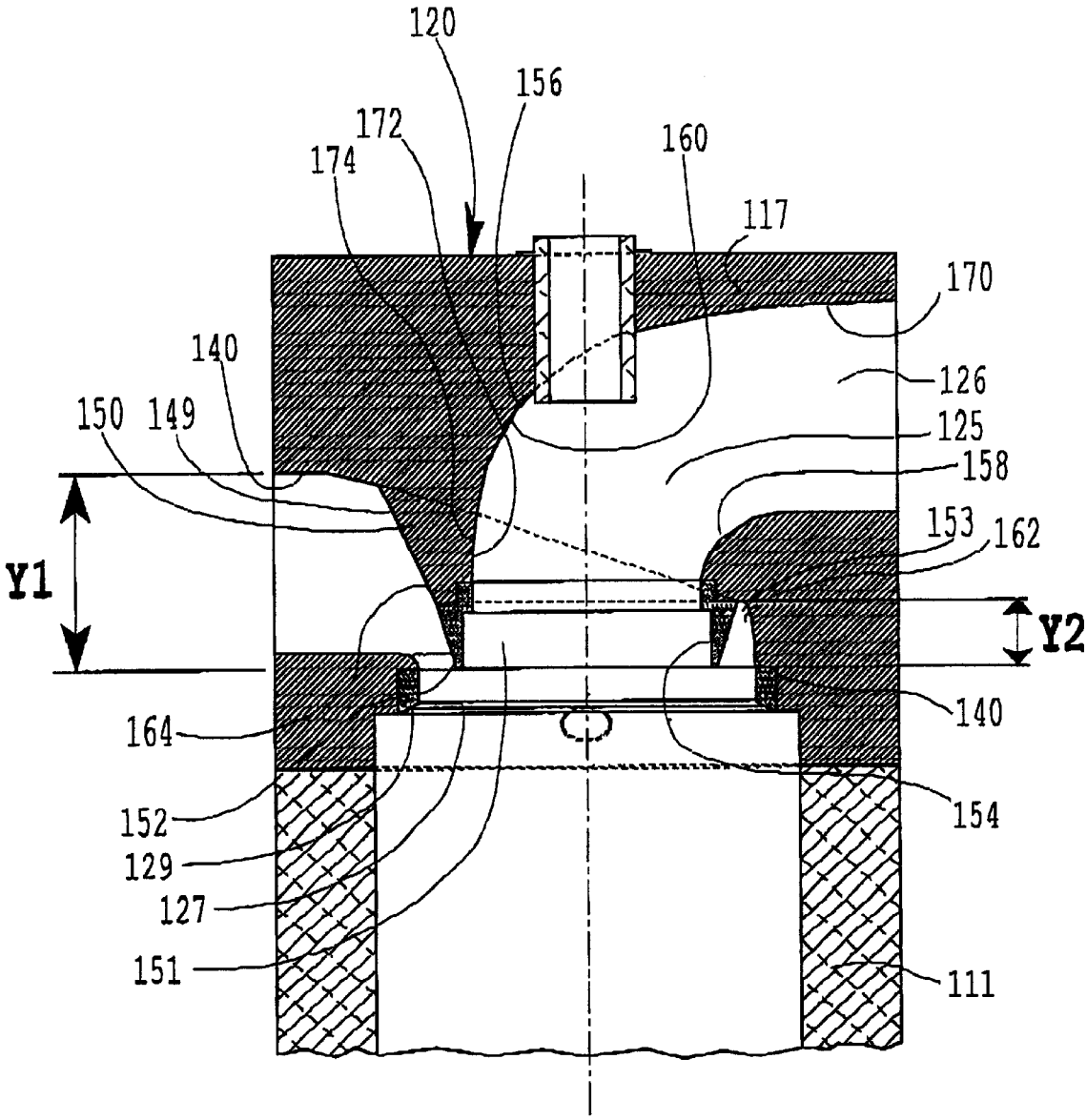
FIG. 24 is a sectional view of the cylinder head without the inlet and exhaust valves in position.

The inlet fluid flow passage 126 follows a curved path towards the inner cavity section 151, as best seen in FIG. 24. The curved path of the flow passage 126 incorporates a bend 156 as it approaches the inner cavity section 151. The bend 156 when viewed in section as shown in FIG. 24 can be considered to have an inner side 158 and an outer side 160. The length of the outer side 160 of the bend 156 is considerably larger than the length of the inner side 158 of the bend 156.

The exhaust fluid flow passage 128 has a boundary wall 140 which extends around, and merges with, the first portion 150 of the wall structure 149 to define the outer surface 164 of the first portion 150 of the wall structure 149. In this way, the inner end section 162 of the exhaust fluid flow passage 128 extends entirely around the wall structure 149. Consequently, the inner end section 162 of the exhaust fluid flow passage 128 is defined between the boundary wall 140 and the wall structure 149, as best seen in FIG. 24.

As the inner end section 162 of the exhaust fluid flow passage 128 extends around the wall structure 149, a section 166 of the boundary wall 140 tapers downwardly to merge with the end of the inner side 158 of the bend 156 in the inlet fluid flow passage.

With this arrangement, the wall structure 149 in separating the outer cavity section 153 from the inner cavity section 151 has an effective length which varies within a range from Y1 to Y2, as shown in FIG. 24.

The dimensions within the range Y1 to Y2 are greater than the axial length of the skirt structure 137 (as identified by reference character X in the first embodiment). As was the case with earlier embodiments, it is desirable for the axial length of the skirt structure 137 to be as small as practicable so as to minimise the reciprocatory mass.

In this embodiment, a concave recess 116 is provided in the top face of the piston 115. The recess 116 is generally aligned with the port 127 and the valve assembly 130.

Figure 22:
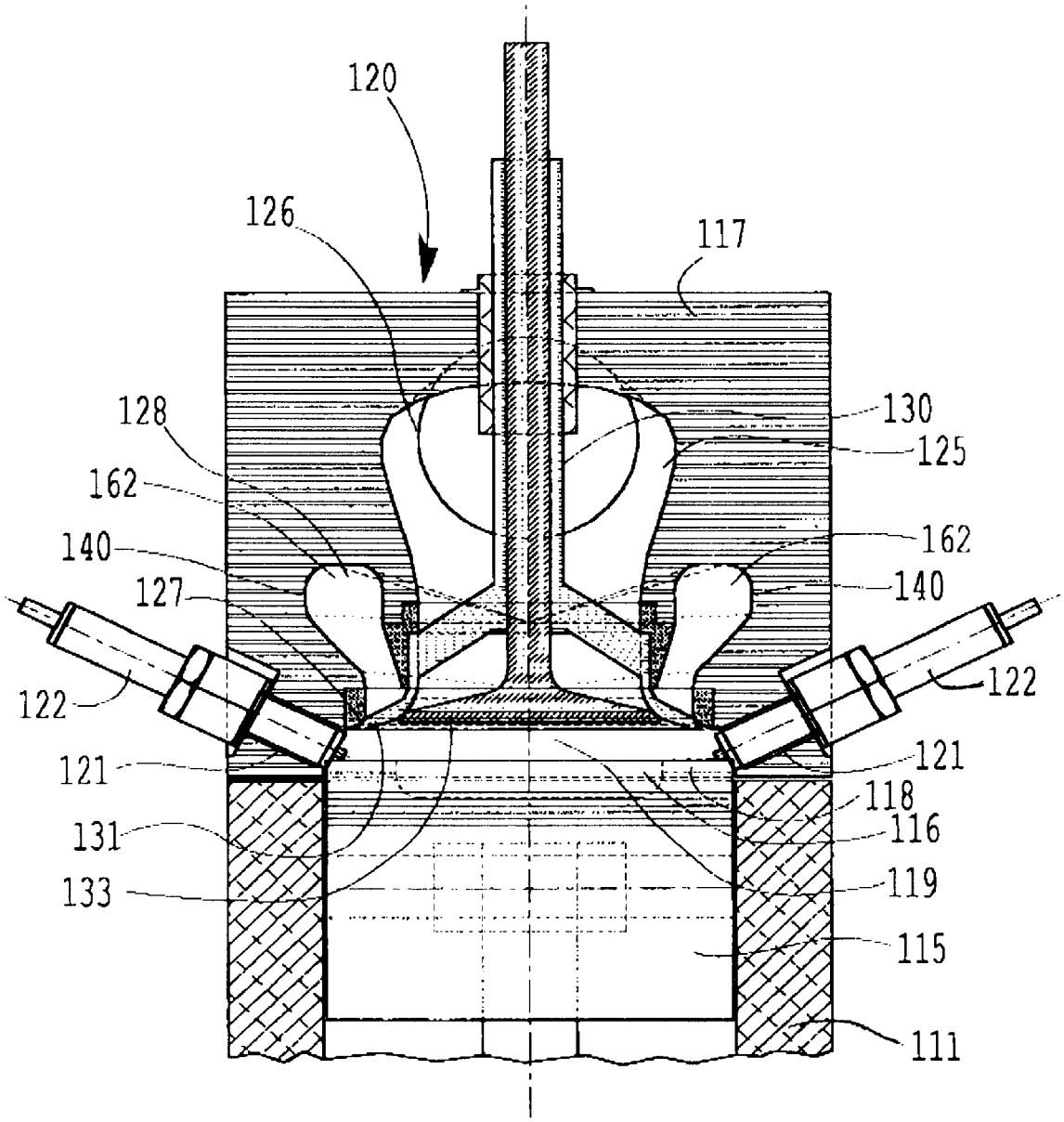
FIG. 22 is a further schematic sectional view of the cylinder head shown in FIG. 18, taken at right angles to the view in the latter Figure to show the exhaust passage extending about the wall structure.
Figure 23:
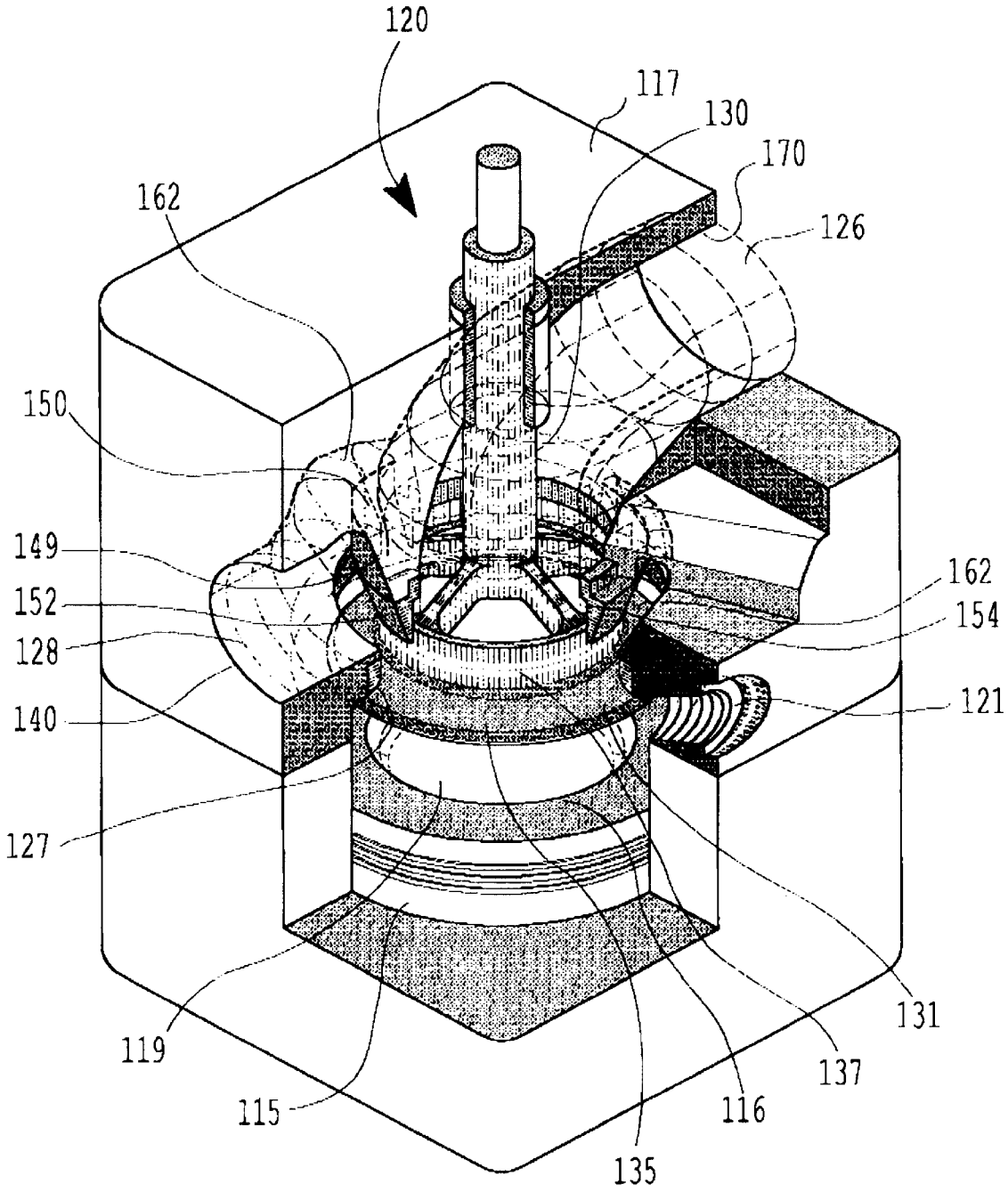
FIG. 23 is a schematic fragmentary perspective view of the cylinder head showing the valve assembly and in particular the exhaust passage extending about the wall structure.

The cylinder head 117 incorporates two threaded holes 121 for accommodating spark plugs 122 on opposed sides of the combustion chamber 119, as shown in FIG. 22.

The arrangement involving the recess 116 in the top face of the piston 115 aligned with the valve assembly 130, together with the two opposed spark plugs 122, provides for a compact combustion chamber 119 which is advantageous.

The top face of the piston 115 incorporates a channel 118 which extends across the face and which provides clearance for the electrodes of the spark plugs 122 when the piston 115 is in its uppermost condition, as shown in FIG. 22.

During a compression stroke of the piston, the air/fuel mixture in the combustion chamber 119 is compressed and urged into the concave recess 116. Effective ignition is achieved because of the use of the two spark plugs 122 which serve to reduce the distance of the flame front needs to travel during the combustion process.

In this embodiment, the wall structure 149 has an effective length which varies in a range from Y1 to Y2 and which in all cases is greater than the axial length of the skirt structure 137. There may, however, be cases where the axial length of the skirt structure 137 is equal to or greater than the length Y2 at the lower end of the range. Such an arrangement may still be effective provided that the most of the dimensions within the range Y1 to Y2 are greater than the axial length of the skirt structure in order to achieve the object of minimising the reciprocating mass of the valve.

It should be appreciated that the scope of the invention is not limited to the scope of the various embodiment described.

Throughout this specification, unless the context requires otherwise, the word "comprise", or variations such as "comprises" or "comprising" will be understood to imply the inclusion of a stated integer or group of integers, but not the exclusion of any other integer or group of integers including method steps.

What is claimed is:

1. An intake and exhaust valve system for an internal combustion engine having a combustion chamber within a cylinder closed at one end by a cylinder head, the valve system comprising a cavity in the cylinder head opening onto the combustion chamber through a first port; a valve assembly comprising first and second valves one of which is an intake valve movable between open and closed conditions for controlling intake fluid flow into the combustion chamber and the other of which is an exhaust valve movable between open and closed conditions for controlling exhaust gas flow from the combustion chamber; the first valve comprising a valve head sealingly engageable with the first port and skirt structure; the skirt structure being in sliding and sealing engagement with a wall structure within the cavity whereby the skirt and the wall structures cooperate to divide the cavity into an inner cavity section and an outer cavity section surrounding the inner cavity section; a first flow passage communicating with the outer cavity section; the wall structure presenting an inner surface defining a boundary for the inner cavity section and an outer surface defining a boundary for the outer cavity section; and a second flow passage communicating with the inner cavity section; the second valve being disposed in the first valve for opening and closing a second port in the first valve for controlling fluid flow between the combustion chamber and inner cavity section; wherein the skirt structure has a first axial length and the wall structure has a second axial length, the first axial length being less than the second axial length.

2. An intake and exhaust valve system according to claim 1 wherein the skirt structure is cylindrical.

3. An intake and exhaust valve system according to claim 1 wherein the first valve has a valve stem connected to the skirt structure.

4. An intake and exhaust valve system according to claim 3 wherein the valve stem is connected to the skirt structure by one or more connecting elements extending therebetween.

5. An intake and exhaust valve system according to claim 4 wherein each connecting element presents a thin profile in the direction of fluid flow.

6. An intake and exhaust valve system according to claim 3 wherein the valve stem is located outside of the confines of the skirt structure.

7. An intake and exhaust valve system according to claim 3 wherein the first valve stem is hollow to provide an axial passage in which the stem of the second valve is received.

8. An intake and exhaust valve system according to claim 7 wherein the stem of the second valve is guidingly supported within the hollow first valve stem for reciprocation relative thereto.

9. An intake and exhaust valve system according to claim 8 wherein second valve stem extends beyond the first valve stem.

10. An intake and exhaust valve system according to claim 1 wherein the first valve and the second valve are connected to means operable to move the valves between their respective open and closed conditions in timed sequence.

11. An intake and exhaust valve system according to claim 2 the wall structure presents a cylindrical face with which the skirt structure slidingly and sealingly engages.

12. An intake and exhaust valve system according to claim 1 wherein the wall structure is releasable mounted in the cavity.

13. An intake and exhaust valve system according to claim 12 wherein the tubular wall structure is defined by an annular body having a mounting flange.

14. An intake and exhaust valve system according to claim 13 wherein the mounting flange is adjacent to and inwardly spaced from one end of the annular body thereby providing a locating portion on the body at said one end, the locating portion being received in a locating recess within the cavity.

15. An intake and exhaust valve system for an internal combustion engine having a combustion chamber within a cylinder closed at one end by a cylinder head, the valve system comprising a cavity in the cylinder head opening onto the combustion chamber through a first port; a valve assembly comprising first and second valves one of which is an intake valve movable between open and closed conditions for controlling intake fluid flow into the combustion chamber and the other of which is an exhaust valve movable between open and closed conditions for controlling exhaust gas flow from the combustion chamber; the first valve comprising a valve head sealingly engagable with the first port and a skirt structure; a wall structure provided in the cavity, with the wall structure or at least a section thereof being removably mounted in the cavity; the skirt structure being in sliding and sealing engagement with the tubular wall structure within the cavity whereby the skirt and wall structures cooperate to divide the cavity into an inner cavity section and an outer cavity section surrounding the inner cavity section; a first flow passage communicating with the outer cavity section; the wall structure presenting an inner surface defining a boundary for the inner cavity section and an outer surface defining a boundary for the outer cavity section and a second flow passage communicating with the inner cavity section; the second valve being disposed in the first valve for opening and closing a second port in the first valve for controlling fluid flow between the combustion chamber and inner cavity section.

16. An intake and exhaust valve system according to claim 15 wherein the wall structure presents a cylindrical face with which the skirt structure slidingly and sealingly engages.

17. An intake and exhaust valve system according to claim 15 or wherein the wall structure is releasably mounted in the cavity.

18. An intake and exhaust valve system according to claim 17 wherein the wall structure is defined by an annular body having a mounting flange.

19. An intake and exhaust valve system according to claim 18 wherein the mounting flange is adjacent to and inwardly spaced from one end of the annular body thereby providing a locating portion on the body at said one end, the locating portion being received in a locating recess within the cavity.

20. An intake and exhaust valve system for an internal combustion engine having a combustion chamber within a cylinder closed at one end by a cylinder head, the valve system comprising a cavity in the cylinder head opening onto the combustion chamber through a first port; a valve assembly comprising first and second valves one of which is an intake valve movable between open and closed conditions for controlling intake fluid flow into the combustion chamber and the other of which is an exhaust valve movable between open and closed conditions for controlling exhaust gas flow from the combustion chamber; the first valve comprising a valve head sealingly engagable with the first port and a skirt structure; the skirt structure being in sliding and sealing engagement with a wall structure within the cavity whereby the skirt and wall structures cooperate to divide the cavity into an inner cavity section and an outer cavity section surrounding the inner cavity section; a first flow passage communicating with the outer cavity section; and a second flow passage communicating with the inner cavity section; the wall structure presenting an inner surface defining a boundary for the inner cavity section an an outer surface defining a boundary for the outer cavity section the second valve being disposed in the first valve for opening and closing a second port in the first valve for controlling fluid flow between the combustion chamber and inner cavity section; the first valve having a valve stem connected to the skirt structure by valve stem being disposed entirely outside of the confines of the skirt structure.

* * * * *